US007475553B2

(12) United States Patent
Brown

(10) Patent No.: US 7,475,553 B2
(45) Date of Patent: Jan. 13, 2009

(54) WIND EFFECT MITIGATION IN CRYOGENIC AMBIENT AIR VAPORIZERS

(75) Inventor: Ross M. Brown, Escondido, CA (US)

(73) Assignee: Cryoquip, Inc., Murrieta, CA (US)

( * ) Notice: Subject to any disclaimer, the term of this patent is extended or adjusted under 35 U.S.C. 154(b) by 316 days.

(21) Appl. No.: 11/185,519

(22) Filed: Jul. 21, 2005

(65) Prior Publication Data

US 2007/0017232 A1 Jan. 25, 2007

(51) Int. Cl.
*F17C 9/02* (2006.01)

(52) U.S. Cl. ..... 62/50.2; 454/11; 454/17; 454/20; 454/21

(58) Field of Classification Search ..... 62/50.2; 454/11, 17, 20, 21
See application file for complete search history.

(56) References Cited

U.S. PATENT DOCUMENTS 3,435,623 A * 4/1969 Tyree, Jr. ..... 62/50.2
3,735,465 A * 5/1973 Tibbetts et al. ..... 29/726
7,137,623 B2 * 11/2006 Mockry et al. ..... 261/128

* cited by examiner

*Primary Examiner*—Cheryl J. Tyler
*Assistant Examiner*—John Pettitt
(74) *Attorney, Agent, or Firm*—William W. Haefliger

(57) ABSTRACT

Apparatus to convert LNG to gas, comprising a vaporizer having passages to pass the cool or cold LNG in heat transfer relation with warming gas flowing downwardly to discharge in multiple directions, and flow control means to control discharge of the gas flow in selected direction or directions, as a function of wind direction.

4 Claims, 3 Drawing Sheets

AMBIENT AIR
AMBIENT AIR
SHUTTERS OPEN
SHUTTERS OPEN
10
11
12
13
14
14a
14b
15
16
17
17a
17b
18
19
20
21
22
23
24
25
25a
26
26a
41
42
43
44

10
11
12
13
14
14
16
16
AMBIENT AIR
AMBIENT AIR
17a
17b
19
21
22
30
30
41
42
45
46
46a
SHUTTERS OPEN
SHUTTERS CLOSED

WIND EFFECT MITIGATION IN CRYOGENIC AMBIENT AIR VAPORIZERS

BACKGROUND OF THE INVENTION

This invention relates generally to efficient vaporization of cryogenic fluids, and more particularly to control of flow of ambient air acting to transfer heat to the cryogenic fluid, with control of air discharge as a function of incident wind direction.

Ambient air vaporizers have been used to convert cryogenic liquids into warm gas for over fifty years. To move the ambient air across the heat transfer surfaces, many rely on the natural draft effect. The cryogenic fluids being warmed (vaporized) are passed adjacent vertical heat transfer surfaces while being heated; and the ambient air descends at the other sides of such surfaces. The change in the density of the air as it cools induces a draft (the opposite of a chimney). The velocity of the induced draft is a function of the change in density. At the outlet (bottom) of the vaporizer, the cooled air typically turns to flow horizontally. For a single operating unit, this will cause discharge of the air in a 360° horizontal fan. In large vaporizer arrays, such as large industrial gas users (steel mills) or LNG re-gasification terminals, the exits may be confined to a single directional axis. As long as sufficient height is provided underneath the vaporizer, as by the vaporizer unit legs, this works well. However, in the event of adverse winds, the static pressure generated by the wind is sufficient to slow or even stop the induced draft, thus curtailing the desired vaporization. With high enough winds, the flow may even reverse, disturbing the temperature profile of adjacent vaporizers.

SUMMARY OF THE INVENTION

It is a major object of the invention to provide an efficient solution to the above problem and difficulties. Basically, the improved apparatus comprises:

a) a vaporizer having passages to pass the cool or cold LNG in heat transfer relation with warming gas flowing downwardly to discharge in multiple directions, such as opposite directions, b) and air flow control means to control discharge of the gas flow, such as air flow, in selected directions, as a function of wind direction.

Typically, a space is provided beneath the vaporizer to receive downward gas flow, for lateral discharge in such selected directions. Also, the flow control means typically includes shutters located at different gas flow discharge locations, and drives to selectively operate the shutters.

It is another object of the invention to provide for vaporization of LNG (liquefied natural gas) in the improved apparatus.

Another object is to provide laterally extending walls, at the lower exteriors of the vaporizers, to block downward flow of ambient air, exteriorly of the vaporizers, into the lateral discharge of gas from the space below the vaporizer.

A further object is to provide an efficient method of vaporization, using ambient air, the method including the steps:

a) providing and operating a vaporizer having passages to pass the cool or cold LNG in heat transfer relation with warming gas flowing downwardly to discharge in multiple directions, b) and providing and operating air flow control means to control discharge of the gas flow in selected directions, as a function of wind direction.

These and other objects and advantages of the invention, as well as the details of an illustrative embodiment, will be more fully understood from the following specification and drawings, in which:

DRAWING DESCRIPTION

DETAILED DESCRIPTION

Figure 1:
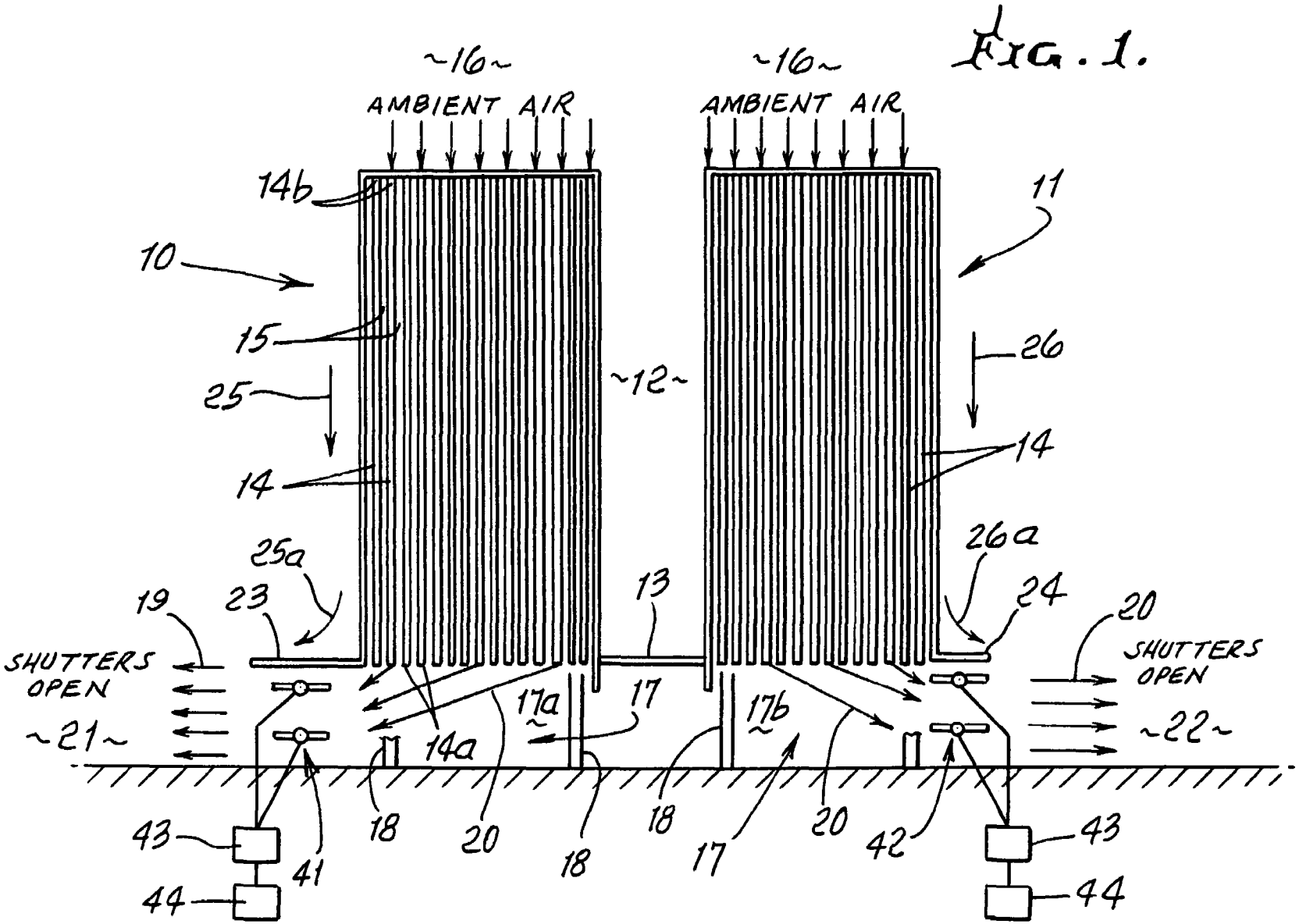
FIG. 1 is an elevation showing vaporizers, flow spaces below the vaporizers, and flow control shutters at ends of such spaces, in positions for no wind operation.

FIG. 1 shows two vaporizers, 10 and 11, extending upright, with access space 12 therebetween. That space is closed off, by horizontal wall 13, extending between the vaporizers. Each vaporizer includes upright tubing 14 to pass cryogenic fluid, such as LNG upwardly between tubing inlets at 14*a* at or near the bottom of the tubes, and tubing outlets 14*b* at or near the upper ends of the tube. Appropriate manifolds are typically provided to supply cryogenic fluid to the inlets, and to remove gas product from the outlets.

Spaces 15 between the tubes pass warming gas such as ambient air downwardly, with natural downward draft, from the regions 16 above the vaporizers, to space 17 below the vaporizers. Appropriate legs, indicated at 18, may be used to support the vaporizers directly above spaces 17. Arrows at 19 and 20 show directions of warming gas or air flow from spaces 17. Arrows 19 indicate air flow to the nearest exterior region 21, from space 17*a* directly below vaporizer 10; and arrows 20 indicate air flow to the nearest exterior region 22, from space 17*b* directly below vaporizer 11. Those flow direction conditions prevail during vaporizer operation under exterior windless or near windless conditions. Lateral walls 23 and 24 at the lowermost sides of the vaporizers block any downward exterior air flow (indicated at 25 and 26) interference with the horizontally escaping air flow at 19 and 20; and also provide for turning of the downward flows 25 and 26 at 25*a* and 26*a* so as to assist in inducing flows 19 and 20.

Figure 2:
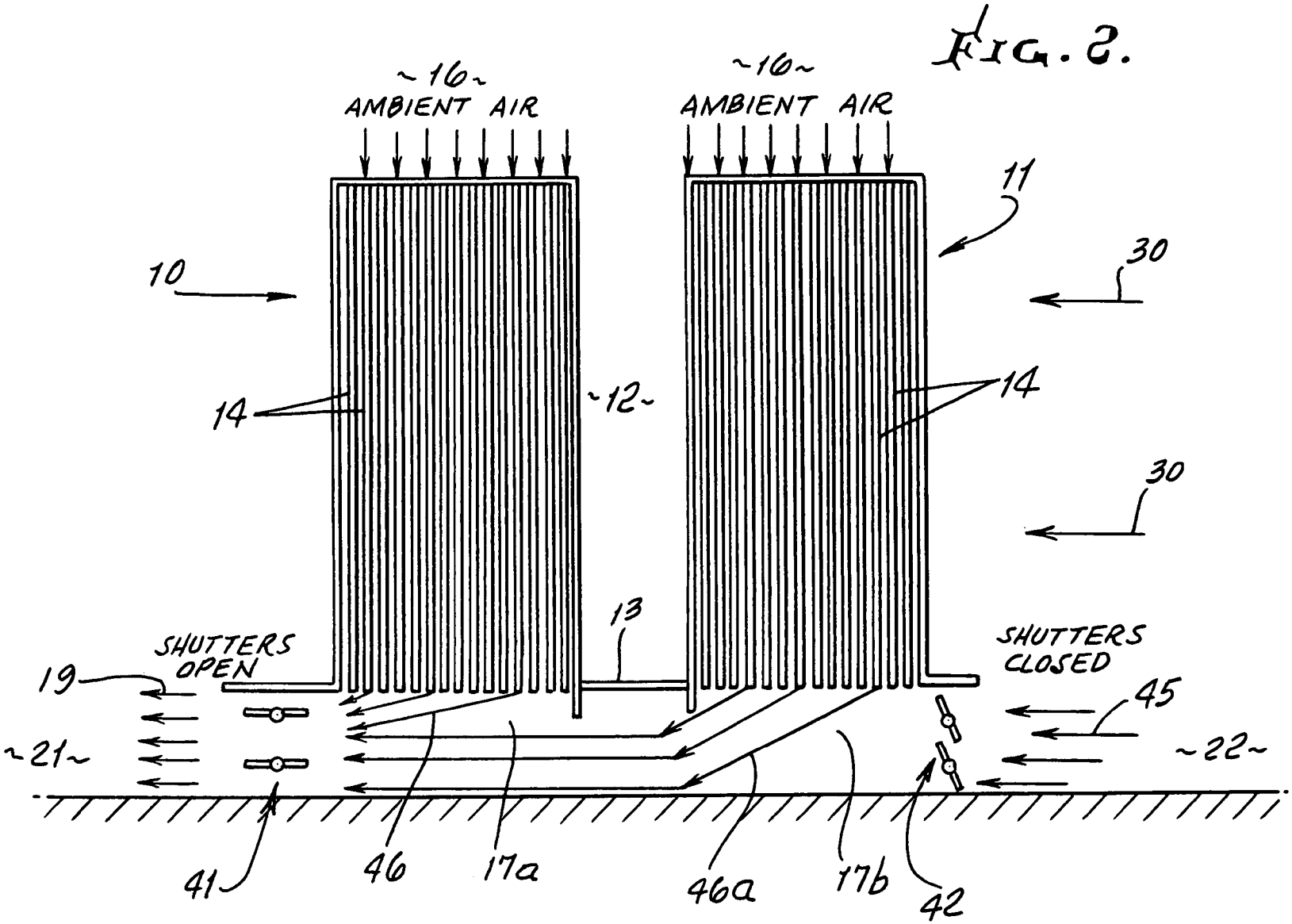
FIG. 2 is a view like FIG. 1, but showing the shutters in positions for a wind condition.

In FIG. 2 a wind condition prevails, in direction indicated by arrows 30. Flow control means is provided to control discharge of the gas flow in spaces 17 selected directions, as a function of wind direction.

Such flow control means may advantageously take the form of shutters shown in a bank at 41 to control flow 19, and in a bank at 42 to control flow 20. One or more shutters may be provided at each bank. The shutters may be rotatable about horizontal axes as shown, to extend at opposite sides of such axes, as shown for balance. Drives may be provided to rotate the shutters between or toward open and closed positions, in response to detected prevailing wind direction. The drives and detectors are indicated schematically at 43 and 44.

In an example of operation, the exits at the bottoms of the vaporizers are oriented on an EAST/WEST axis and equipped with movable shutters. With no wind, or NORTH/SOUTH winds, the shutters remain open as in FIG. 1. In the event of an easterly wind above a threshold (normally 5 to 10 knots), the EAST shutters in bank 42 are closed, forcing all of the cold ambient air discharging from the array out the western portal, i.e. toward 22, as shown in FIG. 2. In the event of westerly winds, the WEST shutters in bank 41 are closed, and shutters in bank 42 remain open. This keeps all vaporizers functioning in a downward natural draft, without substantial interference by wind. The shutters can be self-powered, or power actuated, or latched/released actuated. The shutters can take many forms. Horizontal slat types are illustrated, but they also can be vertical, swing or roll-up doors, or anything that will block air flow.

FIG. 2 shows wind flow impingement at 45 on closed shutters in bank 42; warming air flowing downwardly and angularly at 46 and 46*a* and in spaces 17*a* and 17*b*, toward and through open shutters in bank 41. Flows at 46 and 46*a* are not disturbed by the incident wind 45.

Figure 3:
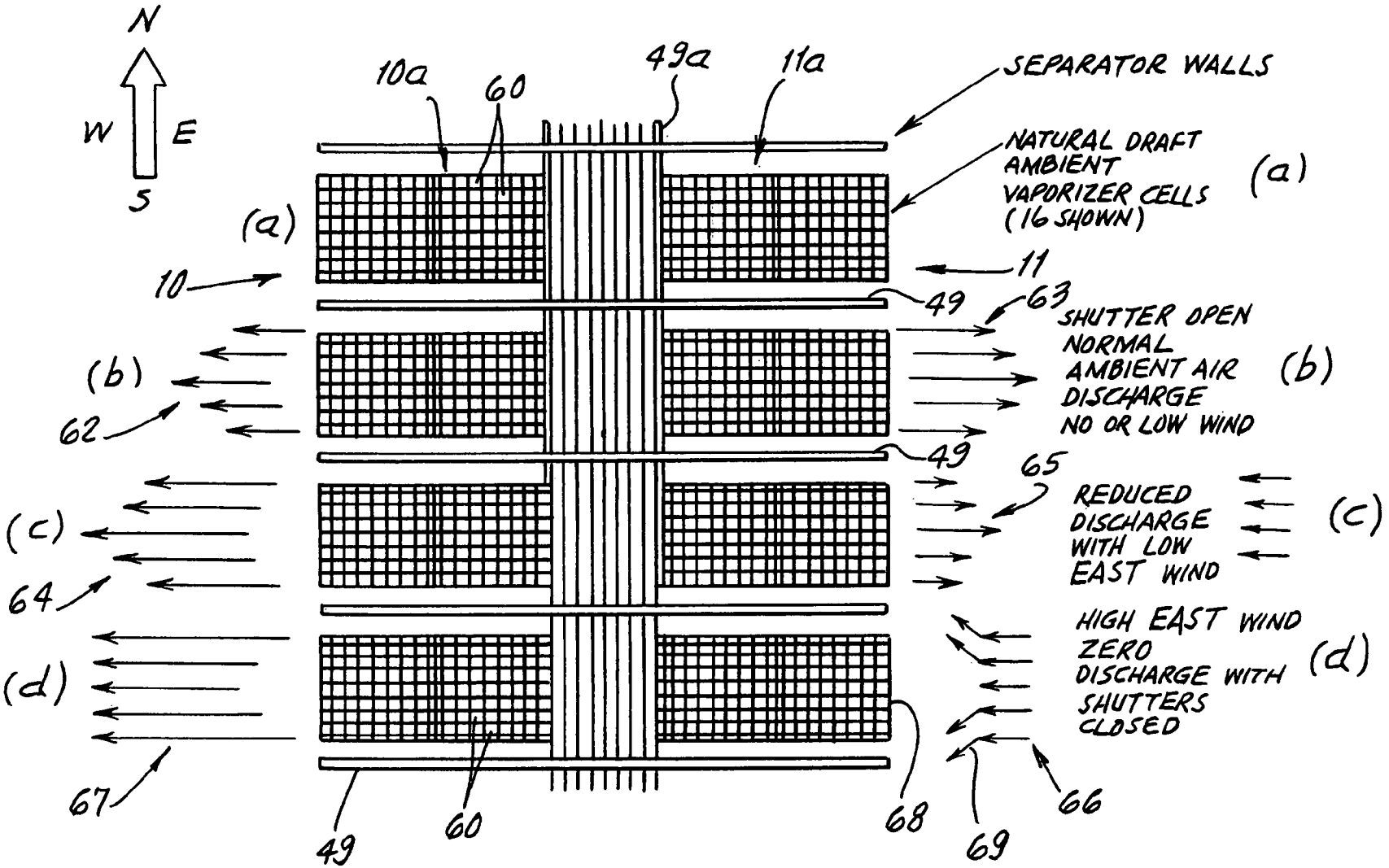
FIG. 3 is a plan view showing multiple vaporizers as operating during wind conditions indicated at a), b), c) and d).

FIG. 3 shows at 3(*a*) and in plan view, banks 10*a* and 11*a* of vaporizers 10 and 11. Walls 49 and 49*a* separate the banks of vaporizers. Vaporizer cells are indicated at 60.

FIG. 3(*b*) shows ambient warming air flow discharged at 62 and 63, for no or low incident wind conditions, shutters in banks 41 and 42 being open.

FIG. 3(*c*) shows warming air flow discharged at 64 and 65, for low EAST wind incidence conditions (flow at 65 reduced, and flow 64 increased).

FIG. 3(*d*) shows warming air flow discharged at 67, for high EAST wind 66 incidence conditions (flow at 67 increased and shutters 41 open, and discharge flow at exit 68 blocked, and shutters 42 closed. Incident wind 66 is directed at 69, so as not to enter spaces 17*a* and 17*b*.

I claim:

1. A method of vaporizing LNG, that includes a) providing and operating vaporizers having passages to pass the LNG in heat transfer relation with warming gas flowing downwardly to discharge in multiple directions, b) and providing and operating gas flow control means to control discharge of the gas flow in selected directions, as a function of wind direction, c) said gas being ambient air, and including providing spaces below the vaporizers having air exits which face in opposite directions, d) said flow control means including shutters in the paths of the gas flow to said exits, e) and including opening the shutters when there is substantially no wind flow toward said exits, f) and including closing the shutters at one of the exits when there is substantial wind flow toward said one exit in the wind direction, and opening the shutters at the other of said exits, g) the LNG passages having inlets at lower locations above shutter level, and outlets at upper locations, spaced above level or levels of said gas flow discharge, h) the vaporizers located in dual closely adjacent banks, spaced apart in a first direction, the shutters located in two groups respectively at furthest apart sides of the two banks whereby each group of shutters can control ambient air discharge from below both banks, and whereby the vaporizers function without substantial interference by wind, i) there being a plurality of said dual banks spaced apart in a second direction, said first and second directions being mutually perpendicular, j) whereby shutters conditions in three of the dual banks spaced apart in a row in said second direction and facing in said first direction are characterized as follows:

$x_1$) open in a first bank with no wind incident from said first direction on said first bank, $x_2$) partly closed in a second bank with relatively low wind incident from said first direction on said second bank, $x_3$) closed in a third bank with relatively high wind incident from said first direction on said third bank.

2. The method of claim 1 wherein said vaporizer air exits face in substantially opposite directions, there being upright walls separating the dual banks in said row.

3. The method of claim 1 wherein said control means includes a wind flow direction detector.

4. The method of claim 3 including providing laterally extending walls, at lower exteriors of the vaporizers, to block downward flow of ambient air, exteriorly of the vaporizers, into the lateral discharge of warming gas from said space.

* * * * *